US012553338B2

(12) United States Patent
Reding et al.

(10) Patent No.: US 12,553,338 B2
(45) Date of Patent: Feb. 17, 2026

(54) DOWNHOLE FLUID SAMPLING SYSTEM WITH HYDRAULIC ACTUATION

(71) Applicant: Halliburton Energy Services, Inc., Houston, TX (US)

(72) Inventors: Christian Reding, Houston, TX (US); James Martin Price, Cypress, TX (US); Anthony Herman van Zuilekom, Houston, TX (US); Matthew L. Lee, Tomball, TX (US); David Earl Ball, Stafford, TX (US); Marcus Ray Hudson, Pearland, TX (US); James Cernosek, Richmond, TX (US); Michael Andrew Pascual, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 58 days.

(21) Appl. No.: 18/403,106

(22) Filed: Jan. 3, 2024

(65) Prior Publication Data

US 2025/0215793 A1 Jul. 3, 2025

(51) Int. Cl.
*E21B 49/08* (2006.01)

(52) U.S. Cl.
CPC ..... *E21B 49/0815* (2020.05); *E21B 49/086* (2013.01); *E21B 49/088* (2013.01)

(58) Field of Classification Search
CPC ... E21B 49/0815; E21B 49/086; E21B 49/088
See application file for complete search history.

(56) References Cited

U.S. PATENT DOCUMENTS 3,577,781 A * 5/1971 Lebourg ..... E21B 49/10 166/264
5,058,674 A 10/1991 Schultz et al.
(Continued)

FOREIGN PATENT DOCUMENTS

CN 113567302 A 10/2021
WO 2020112106 A1 6/2020

OTHER PUBLICATIONS

PCT/US2024/010134 , "International Search Report and Written Opinion", Sep. 25, 2024, 8 pages.
(Continued)

*Primary Examiner* — Nicole Coy
*Assistant Examiner* — Jennifer A Railey
(74) *Attorney, Agent, or Firm* — Kilpatrick Townsend & Stockton LLP

(57) ABSTRACT

A downhole fluid sampling system with hydraulic actuation can be used to collect one or more samples of formation fluid during a well operation. The sampling system can be within a downhole tool deployed in a wellbore of the well operation. Then sampling system then can collect a first sample from the flow of formation fluid from the wellbore using a first sampling chamber of a sampling unit in the sampling system. The sampling unit can define a set of sampling chambers including the first sampling chamber and a second sampling chamber. A piston of the sampling system that actuates on hydraulic fluid can advance the sampling unit by a predefined distance from a first position associated with the first sampling chamber to a second position associated with the second sampling chamber. Subsequently, the second sampling chamber can collect a second sample from the flow of formation fluid.

20 Claims, 4 Drawing Sheets

(56) References Cited

U.S. PATENT DOCUMENTS

| | | | | |
|---|---|---|---|---|
| 5,337,822 | A | 8/1994 | Massie et al. | |
| 6,192,984 | B1 | 2/2001 | Schultz | |
| 2006/0076144 | A1* | 4/2006 | Shammai | E21B 49/10 166/370 |
| 2007/0205021 | A1* | 9/2007 | Pelletier | E21B 49/086 166/264 |
| 2017/0260856 | A1* | 9/2017 | Crabeil | E21B 47/06 |
| 2022/0389813 | A1 | 12/2022 | Pelletier et al. | |

OTHER PUBLICATIONS

Halliburton Energy Services, Inc , Unpublished U.S. Appl. No. 18/307,875, filed Apr. 27, 2023.

* cited by examiner

DOWNHOLE FLUID SAMPLING SYSTEM WITH HYDRAULIC ACTUATION

TECHNICAL FIELD

The present disclosure relates generally to wellbore operations and, more particularly (although not necessarily exclusively), to a downhole fluid sampling system with hydraulic actuation.

BACKGROUND

A well system, such as an oil and gas well system, may include a wellbore drilled through a subterranean formation to extract hydrocarbons or other suitable material. Formation fluid can include any fluid that occurs in pores of the subterranean formation. Strata containing different types of fluid, such as oil, gas, or water, may be encountered during wellbore operations, such as when drilling the wellbore through the subterranean formation. Sampling formation fluid for analysis can provide information on composition, properties, or behavior of the formation fluid that can be used to facilitate reservoir characterization and management. A downhole tool can be deployed in the wellbore to collect samples from the formation fluid. Scaling up tools to collect multiple samples may be limited by space available in the downhole tool to accommodate additional electrical or mechanical components used to collect the samples.

DETAILED DESCRIPTION

Figure 1:
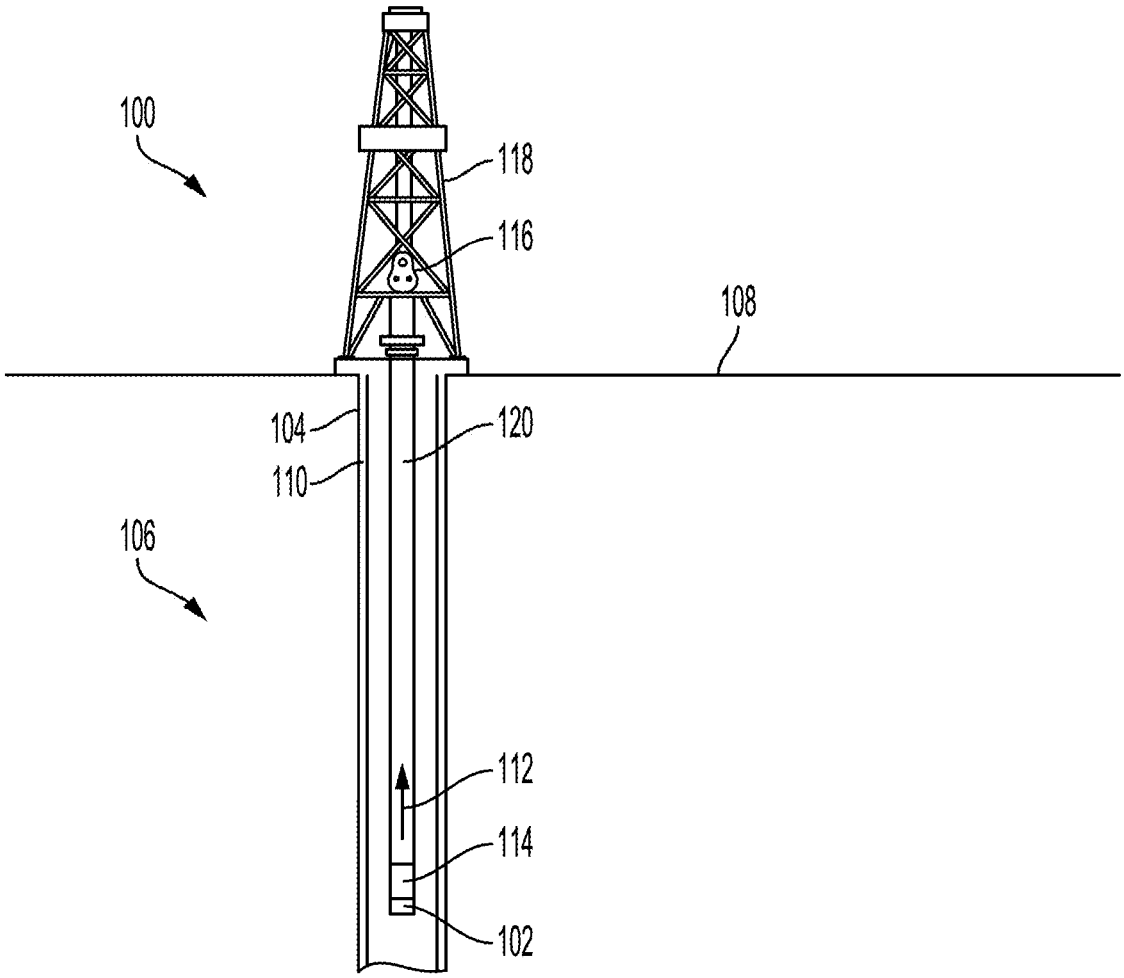
FIG. 1 is an example of a wellsite that includes a downhole fluid sampling system with hydraulic actuation according to one example of the present disclosure.

Certain aspects and examples of the present disclosure relate to a downhole fluid sampling system with hydraulic actuation. The sampling system can be positioned in a downhole tool deployed downhole in a wellbore such that the sampling system can collect multiple samples of formation fluid in the wellbore. The sampling system can collect the samples of the formation fluid prior to, during, or after a wellbore operation associated with the wellbore. The sampling system can include a sampling unit that can define a set of sampling chambers to collect and store the samples of the formation fluid. The sampling chambers can be arranged in the sampling unit such that changing a position of the sampling unit can modify which sampling chamber of the set of sampling chambers is positioned to receive the formation fluid. As pressure from the formation fluid entering the sampling system builds, a piston of the sampling system can actuate on hydraulic fluid in the sampling system to advance the sampling unit from a starting position to an updated position. Accordingly, after adjusting the position of the sampling unit, a sampling chamber corresponding to the updated position can collect a sample from the formation fluid.

The sampling system can include a spring positioned adjacent to the piston such that the piston compresses the spring when actuating on the hydraulic fluid. Once the piston is depressurized due to a lack of formation fluid entering the sampling system, spring force provided by the spring can return the piston to an initial position of the piston, completing a pressurization-depressurization cycle. If there are more than two sampling chambers defined by the sampling unit, additional pressurization-depressurization cycles can be performed to collect additional samples of the formation fluid using any remaining sampling chambers of the set of sampling chambers. Once the sampling system returns to a well surface of the wellbore, the sampling unit can be retrieved from the sampling system to remove the samples from the set of sampling chambers for analysis.

Using hydraulic actuation to implement the sampling system can enable the sampling system to capture multiple samples while avoiding additional hardware to capture each sample. Increasing a number of samples captured by the sampling system can be facilitated by the hydraulic actuation of the sampling system. Instead of needing to duplicate electrical hardware for electrical actuation, the hydraulic actuation of the sampling system can enable increased samples captured by the sampling unit using additional sampling chambers and additional filling cycles. The downhole fluid sampling system can use power provided by a downhole pump that is transmitted via the formation fluid to capture individual samples of the formation fluid. Each pressurization-depressurization cycle can enable the downhole fluid sampling system to capture an additional sample of the formation fluid, thereby staggering when each sample is captured. Accordingly, the downhole fluid sampling system can be used to capture multiple samples of the formation fluid over a predefined time range such that properties of the formation fluid can be monitored over the predefined time range.

The sampling system can include a body with an exterior exposed to a downhole wellbore environment. The body of the sampling system can define multiple openings, such as a formation fluid inlet coupled to the downhole pump, a formation fluid outlet, and a borehole fluid inlet. The formation fluid of the wellbore can enter the sampling system through the formation fluid inlet. Once the formation fluid enters the sampling system, the formation fluid can flow through an internal passage of the sampling system to a sampling unit of the sampling system used to capture the formation fluid.

Additionally, the formation fluid can continue to flow through the internal passage to the formation fluid outlet of the sampling system. While pressure within the sampling system is relatively low (e.g., below a predefined threshold), the formation fluid may be unable to exit the sampling system via the formation fluid outlet. In some implementations, the formation fluid outlet may include an outlet seal (e.g., a metal-metal seal), a relief valve, or a combination thereof to control whether the formation fluid can exit through the formation fluid outlet. A valve spring coupled to the relief valve can provide a spring force to ensure that the relief valve remains in a closed position. A piston of the sampling system can use a different seal to prevent intermixing of the formation fluid and hydraulic fluid stored in a hydraulic fluid cavity. A piston spring can exert another spring force to push the piston away from the hydraulic fluid cavity. Examples of the valve spring and the piston spring can include a coned-disc spring, a wavy spring, a bellow, or any suitable elastic device.

As the pressure in the sampling system builds, the piston can compress the piston spring until the piston reaches a location threshold defined by the body of the sampling system. As the piston compresses the piston spring, a volume of hydraulic fluid can exit from the hydraulic fluid cavity and displace the sampling unit by a predefined distance between an initial position and an updated position. Once the sampling unit is in the updated position, an sampling chamber of the sampling unit can be positioned to receive the flow of the formation fluid. Prior to collecting a sample from the flow of the formation fluid, the sampling chamber can be flushed using the formation fluid, for example to remove contaminants. In some cases, when the pressure of the sampling system is relatively high (e.g., above the predefined threshold), the pressure can cause the relief valve to overcome the spring force of the valve spring and move to an open position. As a result, the formation fluid can continually flow through the sampling system, removing the contaminants from the sampling chamber and preparing the sampling chamber to capture a suitable sample. In additional or alternative cases, a valve may be actuated (e.g., electrically) to communicate the formation fluid to ambient atmosphere. As a result, the formation fluid can continually flow through the sampling system to remove the contaminants while remaining at relatively low pressure.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is an example of a wellsite 100 that includes a downhole fluid sampling system 102 with hydraulic actuation according to one example of the present disclosure. As depicted in FIG. 1, the wellsite 100 includes a wellbore 104 drilled through a subterranean formation 106. The wellbore 104 extends from a well surface 108 into strata of the subterranean formation 106. The strata can include different materials (e.g., rock, soil, oil, water, gas, etc.) and can vary in thickness and shape. In some examples, the wellsite 100 may include more than one wellbore 102. Additionally, the wellbore 104 can be vertical as depicted, deviated, horizontal, or any combination thereof.

The wellbore 104 can be cased, open-hole, or a combination thereof. For example, a casing string 110 can extend from the well surface 108 through the subterranean formation 106. The casing string 110 may provide a conduit through which a flow of formation fluid 112, such as production fluid produced from the subterranean formation 106, can travel from the wellbore 104 to the well surface 108. In some examples, the casing string 110 can be coupled to walls of the wellbore 104 via cement. For example, a cement sheath can be positioned or formed between the casing string 110 and the walls of the wellbore 104 to couple the casing string 110 to the wellbore 104.

The wellbore 104 additionally can include one or more well tools, such as a downhole tool 114. In the example shown in FIG. 1, the downhole tool 114 is positioned in the wellbore 104 by a winch 116 in a derrick 118 positioned above the well surface 108. In other examples, the downhole tool 114 may be positioned in the wellbore 104 in another manner. The downhole tool 114 can be coupled to a tool string 120 to position the downhole tool 114 in the wellbore 104. The downhole tool 114 can be transported into the wellbore 104 by manipulating the tool string 120 using, for example, a guide or the winch 116. In some examples, a wireline or slickline may be used in place of the tool string 120.

The downhole tool 114 can include at least one subsystem to measure properties of a downhole environment of the wellbore 104. The subsystem may measure properties of the rocks, the flow of the formation fluid 112, or other contents of the subterranean formation 106. As an example, the subsystem of the downhole tool 114 can be the sampling system 102 with hydraulic actuation that can be used to measure properties of the formation fluid 112. Examples of the properties of the formation fluid 112 can include viscosity, methane content, density, solids content, impurity content, or a combination thereof. The sampling system 102 can collect one or more samples of the formation fluid 112 that may be used to analyze the formation fluid 112 and determine the properties of the formation fluid 112. In additional or alternative examples, the subsystem can include one or more components in addition to the sampling system 102. Examples of the components can include a logging-while-drilling (LWD) module, a measuring-while-drilling (MWD) module, a rotary steerable system, a motor, a pump, or any combination thereof. In some implementations, the components may be positioned on the tool string 120. For example, the components may be positioned downhole from the sampling system 102 such that the tool string 120 extends downhole past the sampling system 102 to house the components.

Figure 2:
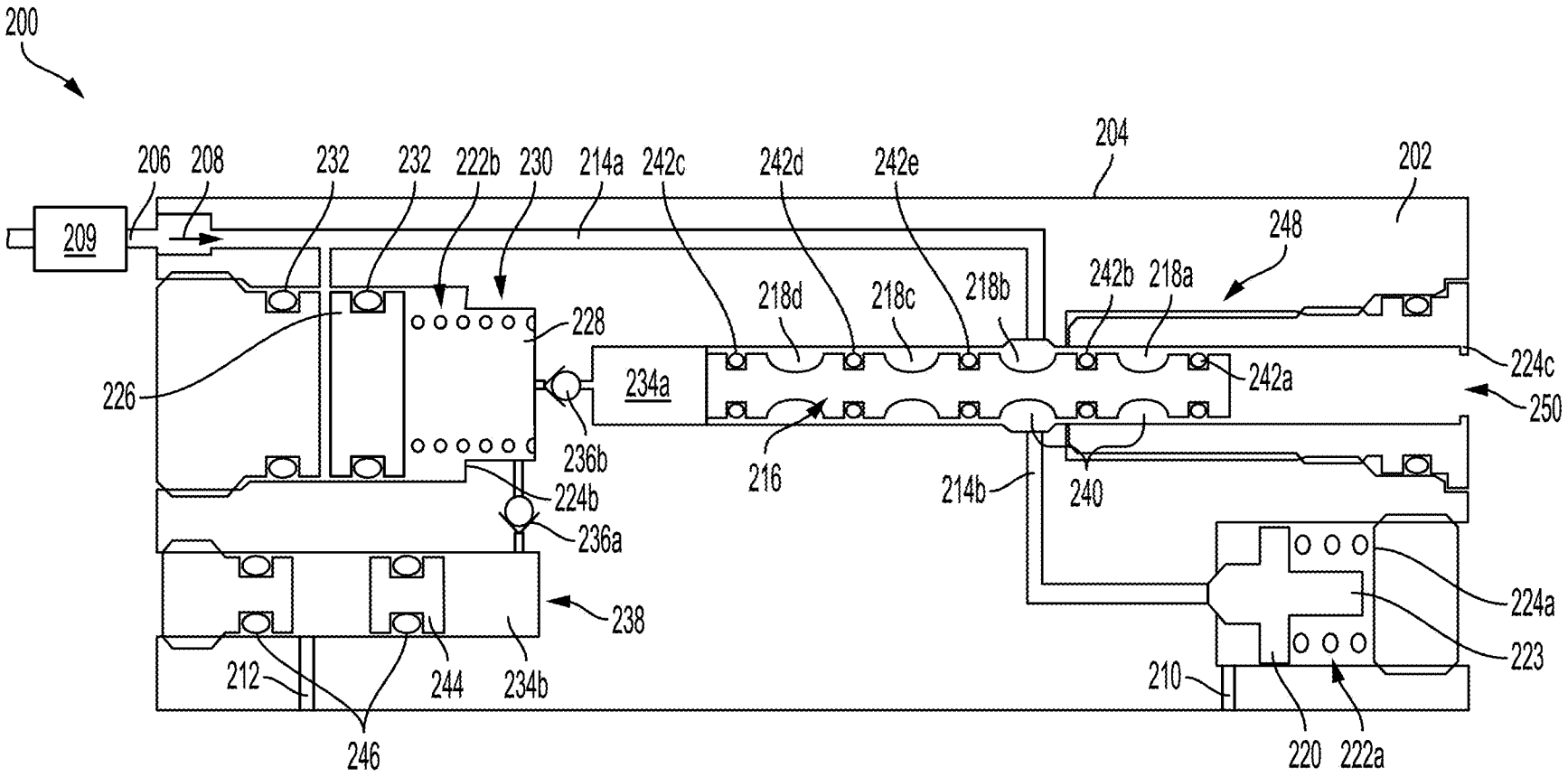
FIG. 2 is a schematic of an example of a downhole fluid sampling system with hydraulic actuation according to one example of the present disclosure.

FIG. 2 is a schematic of an example of a downhole fluid sampling system 200 with hydraulic actuation according to one example of the present disclosure. As depicted in FIG. 2, the sampling system 200 can include a body 202 with an exterior 204 exposed to a downhole environment of a wellbore (e.g., the wellbore 104 of FIG. 1). The body 202 of the sampling system 200 can be part of or positioned within a tubing string (e.g., the tool string 120 of FIG. 1). The sampling system 200 additionally can include one or more inlets or outlets to enable fluid to travel into and out of the sampling system 200. For example, the sampling system 200 can include a formation fluid inlet 206 such that formation fluid 208 of the wellbore can enter the sampling system 200 via the formation fluid inlet 206. In some examples, a pump 209 can be coupled to the formation fluid inlet 206 to pump the formation fluid 208 from the downhole environment into the sampling system 200. After traveling through the sampling system 200, the formation fluid 208 can exit the sampling system 200 via a formation fluid outlet 210 of the sampling system 200. In some examples, the sampling system 200 can additionally include a borehole fluid inlet 212 through which downhole fluid from the wellbore can enter the sampling system 200.

Once the sampling system 200 receives the formation fluid 208 from the formation fluid inlet 206, the formation fluid 208 can flow through a first internal passage 214*a* coupled to the formation fluid inlet 206 to arrive at a sampling unit 216. In some implementations, the sampling unit can be cylindrically shaped (e.g., a rod). The sampling unit 216 can define a set of sampling chambers 218*a-d* used to collect a subset of the formation fluid 208 as the formation fluid 208 flows through the first internal passage 214*a* to a second internal passage 214*b* of the sampling system 200. In some cases, the set of sampling chambers 218*a-d* can be annular chambers arranged linearly along the sampling unit 216.

As depicted in FIG. 2, the sampling unit 216 can include a first sampling chamber 218*a*, a second sampling chamber 218*b*, a third sampling chamber 218*c*, and a fourth sampling chamber 218*d*. Although four sampling chambers are depicted in FIG. 2, it will be appreciated that any number of sampling chambers can be defined by the sampling unit 216. Each sampling chamber of the set of sampling chambers 218*a-d* can collect a respective sample from the formation fluid 208. For example, as depicted in FIG. 2, the second sampling chamber 218*b* is coupled to the first internal passage 214*a* to receive the formation fluid 208 entering the sampling system 200 through the formation fluid inlet 206. Each sample collected by a respective sampling chamber can be stored in the sampling unit 216 until the samples are retrieved for analysis.

The second internal passage 214*b* can be coupled to the formation fluid outlet 210. In some examples, a relief valve 220 or another suitable flow control mechanism can be positioned in the second internal passage 214*b* upstream from the formation fluid outlet 210 to control when the formation fluid 208 can exit the sampling system 200. The relief valve 220 can be adjusted between an open position and a closed position based on pressure within the sampling system 200. The pressure of the sampling system 200 can be generated by the pump 209 that pumps the formation fluid 208 into the sampling system 200. For example, when the pressure is relatively low (e.g., below a predefined threshold), the relief valve 220 can be at the closed position to prevent the formation fluid 208 from flowing through the formation fluid outlet 210 to exit the sampling system 200. As the pump 209 continues to transport the formation fluid 208 into the sampling system 200, the pressure in the sampling system 200 can build due to the formation fluid 208 being unable to exit the sampling system 200. In some cases, the relief valve 220 can establish a seal between the body 202 of the sampling system 200 and the relief valve 220 to prevent the formation fluid 208 from exiting the sampling system 200. Examples of the seal can include a metal-metal seal, an O-ring seal, a shear seal, a bore-transferring seal, or a combination thereof.

In some examples, a first spring 222*a* can be positioned adjacent to the relief valve 220 to bias the relief valve 220 into the closed position. A first spring force provided by the first spring 222*a* can prevent the relief valve 220 from moving into the open position until the predefined threshold of the pressure in the sampling system 200 is reached. To move into the open position, the relief valve 220 can compress the first spring 222*a* until a surface 223 of the relief valve 220 contacts a first shoulder 224*a* of the body 202. Once the relief valve 220 contacts the first shoulder 224*a*, the formation fluid outlet 210 can be unsealed. Accordingly, the formation fluid 208 can exit from the sampling system 200 through the formation fluid outlet 210. When the relief valve 220 is in the open position, the downhole fluid (e.g., the formation fluid 208) can be continually pumped by the pump 209 through the sampling system 200 while maintaining a position of the sampling unit 216. Thus, the downhole fluid can flush a particular sampling chamber coupled to the first internal passage 214*a* to ensure that contaminants (e.g., solid particulates, salts, organic material, etc.) in the particular sampling chamber are removed.

To enable each sampling chamber of the set of sampling chambers 218*a-d* to collect the respective sample, the sampling system 200 can include a piston 226 that can actuate on hydraulic fluid 228 to displace the sampling unit 216. Examples of the hydraulic fluid 228 can include water, mineral oil, or other suitable fluids. The piston 226 can be positioned in a hydraulic fluid cavity 230 that contains the hydraulic fluid 228. A first set of seals 232 can be positioned adjacent to the piston 226 to prevent fluid communication of the formation fluid 208 with the hydraulic fluid 228 in the hydraulic fluid cavity 230. As the formation fluid 208 continues to flow into the sampling system 200 while the relief valve 220 is in the closed position, the piston 226 can be pressurized to compress a second spring 222*b* positioned adjacent to the piston 226. As the pressure in the sampling system 200 increases, the piston 226 can continue compressing the second spring 222*b* until the piston 226 contacts a second shoulder 224*b* defined by the body 202 of the sampling system 200. In some implementations, the first spring force exerted by the first spring 222*a* may exceed a second spring force provided by the second spring 222*b*. As a result, the first spring 222*b* may remain in place when the piston 226 overcomes the second spring force to compress the second spring 222*b*.

As the piston 226 approaches the second shoulder 224*b* of the sampling system 200 at the conclusion of a first sampling cycle, the piston 226 can displace a first volume 234*a* of the hydraulic fluid 228 such that the first volume 234*a* of the hydraulic fluid 228 can advance the sampling unit 216. The sampling system 200 can include a first check valve 236*a* to prevent the first volume 234*a* of the hydraulic fluid 228 from flowing back into a hydraulic fluid reservoir 238. Dimensions of the piston 226, the hydraulic fluid cavity 230, the hydraulic fluid reservoir 238, the second spring 222*b*, or a combination thereof can be determined to ensure that the first volume 234*a* of the hydraulic fluid 228 advances the sampling unit 216 by a predefined distance 240. The predefined distance 240 can correspond to a distance between two sampling chambers of the sampling unit 216. In some examples, a second set of seals 242*a-e* can be positioned in an alternating arrangement between the set of sampling chambers 218*a-d*. The second set of seals 242*a-e* can prevent adjacent sampling chambers from communicating fluid (e.g., intermixing between the first sample and the second sample). For example, the first sampling chamber 218*a* can be flanked by a first seal 242*a* and a second seal 242*b* of the second set of seals 242*a-e*. A distance between the first seal 242*a* and the second seal 242*b* can demarcate the predefined distance 240.

By displacing the sampling unit 216 by the predefined distance 240, the first volume 234*a* of the hydraulic fluid 228 can cause the sampling unit 216 to move from a first position associated with the first sampling chamber 218*a* to a second position associated with the second sampling chamber 218*b*. For example, while the sampling unit 216 is in the first position, the first sampling chamber 218*a* can collect a first sample of the formation fluid 208. Subsequently, the piston 226 can actuate on the hydraulic fluid 228 to advance the sampling unit 216 from the first position to the second position such that the second sampling chamber 218*b* can be positioned to collect a second sample of the formation fluid 208. In some cases, the sampling unit 216 moving from the first position to the second position can cause the second seal 242*b* to arrive at a previous location of the first seal 242*a*.

As an amount of the formation fluid 208 in the sampling system 200 continues to increase, the pressure in the sampling system 200 can build and reach the predefined threshold, causing the relief valve 220 to move to the open position. Once the relief valve 220 is in the open position, the downhole fluid from the wellbore can flow through the first internal passage 214*a* to flush the second sampling unit 218*b* before the second sampling unit 218*b* collects the second sample. After sufficient flushing, the downhole fluid may stop entering the sampling system 200 via the formation fluid inlet 206, resulting in depressurization of the sampling system 200. As the pressure of the sampling system 200 decreases, the first spring 222*a* and the second spring 222*b* can return to an equilibrium position where the springs 222*a-b* are not compressed. As a result, the relief valve 220 can re-establish contact with the body 202 of the sampling system 200 to seal the formation fluid exit 210, preventing fluid from exiting the sampling system 200.

Additionally, when the second spring 222*b* returns to its equilibrium position, the hydraulic fluid cavity 230 can receive a second volume 234*b* of the hydraulic fluid 228 from the hydraulic fluid reservoir 238. The second volume 234*b* of the hydraulic fluid 228 can replace the first volume 234*a* of the hydraulic fluid 228 displaced by the piston 226 to advance the sampling unit 216. The first volume 234*a* and the second volume 234*b* of the hydraulic fluid 228 can be equal. In some examples, the hydraulic fluid reservoir 238 can provide the second volume 234*b* of the hydraulic fluid 228 to the hydraulic fluid cavity 230 via the first check valve 236*a* coupling the hydraulic fluid reservoir 238 to the hydraulic fluid cavity 230. As depicted in FIG. 2, the hydraulic fluid reservoir 238 can be a compensated hydraulic fluid reservoir with a compensator 244 to ensure that fluid pressure of the second volume 234*b* of the hydraulic fluid 228 in the hydraulic fluid reservoir 238 is the same as ambient pressure. In some examples, the compensator 244 can be a bladder system.

In some examples, when the second volume 234*b* of the hydraulic fluid 228 enters the hydraulic fluid reservoir 238, the sampling unit 216 can maintain its current position due to a first seal friction of the second set of seals 242*a-e* being greater than a second seal friction associated with the compensator 244. For example, the hydraulic fluid reservoir 238 can include a third set of seals 246 that can provide the second seal friction. The sampling unit 216 can maintain the second position after the second spring 222*b* returns to its equilibrium position until the pressure in the sampling system 200 again reaches the predefined threshold.

Additionally or alternatively, the sampling system 200 can include a second check valve 236*b* to control flow of the hydraulic fluid 228 from the hydraulic fluid cavity 230 to the sampling unit 216. For instance, the second check valve 236*b* can implement a one-way flow function to prevent the hydraulic fluid 228 from flowing back into the hydraulic fluid cavity 230 after the hydraulic fluid 228 is displaced by the piston 226. Accordingly, the second check valve 236*b* can reduce reliance on the seal frictions to maintain the current position of the sampling unit 216. For example, when the second spring 222*b* returns to its equilibrium position, the second check valve 236*b* can prevent backflow of the first volume 234*a* of the hydraulic fluid 228, enabling the sampling unit 216 to maintain the second position.

Subsequent pressurization-depressurization cycles can advance the sampling unit 216 to enable the third sampling chamber 218*c* and the fourth sampling chamber 218*d* to collect respective samples from the formation fluid 208 after flushing. As the set of sampling chambers 218*a-d* are filled, the sampling unit 216 can advance toward a receiving unit 248 of the sampling system 200 while displacing fluid from a vent port 250 of the sampling system 200. The sampling system 200 can define a third shoulder 224*c* to prevent the sampling unit 216 from advancing outside of the sampling system 200. The receiving unit 250 can store the sampling unit 216 until the samples of the sampling unit 216 can be retrieved. In some examples, the receiving unit 250 can be removed from the sampling system 200 to retrieve the samples. For example, the receiving unit 250 may be a cartridge that can be removed while the sampling system 200 is positioned downhole. Additionally or alternatively, the receiving unit 250 may be removed when the sampling system 200 returns to a well surface (e.g., the well surface 108 of FIG. 1) of the wellbore.

Figure 3:
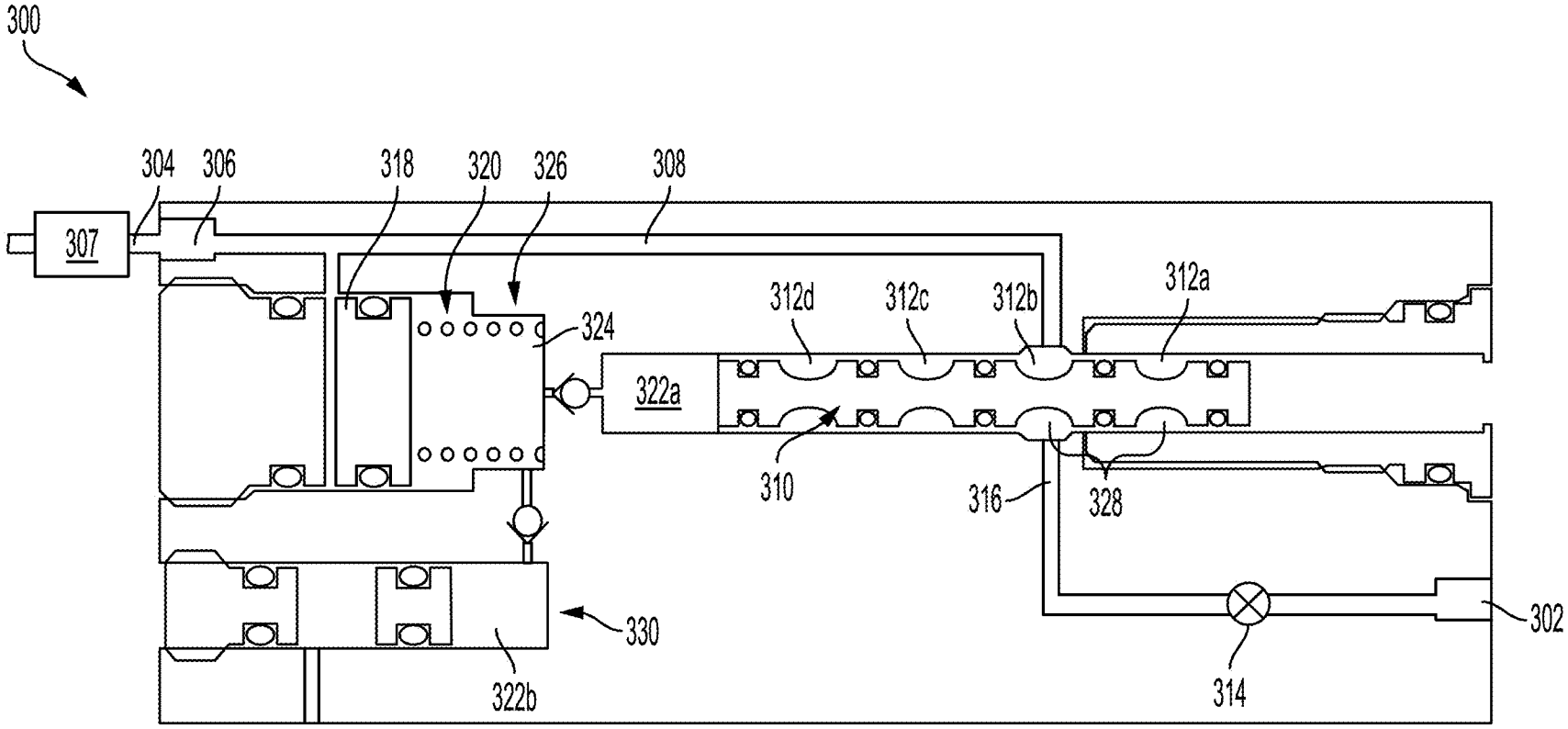
FIG. 3 is a schematic of another example of a downhole fluid sampling system with hydraulic actuation according to one example of the present disclosure.

FIG. 3 is a schematic of another example of a downhole fluid sampling system with hydraulic actuation according to one example of the present disclosure. In some examples, as depicted in FIG. 3, a sampling system 300 may include a sample fluid outlet 302 in place of the relief valve 220 of FIG. 2. The sampling system 300 can be positioned in series to a flowline deployed downhole in a wellbore (e.g., the wellbore 104 of FIG. 1), rather than being positioned in a branch of the flowline. Thus, formation fluid 306 can constantly flow into the sampling system 300 through a formation fluid inlet 304. Additionally, similar to the sampling system 200 described with respect to FIG. 2, a pump 307 can pump the formation fluid 306 into the sampling system 300 from a downhole environment of the wellbore.

An internal passage 308 of the sampling system 300 can couple a sampling unit 310 to the formation fluid inlet 304 such that a set of sampling chambers 312*a-d* defined by the sampling unit 310 can collect samples of the formation fluid 306. Due to the constant flow of the formation fluid 306, a separate flushing operation can be avoided. In some examples, the flowline can be a tubing string (e.g., the tool string 120 of FIG. 1) or other suitable types of work string.

To capture a sample, pressure in the sampling system 300 can be increased by closing a valve 314 in a sample line 316. While the valve 314 is in a closed position, the pump 307 can continue to pump the formation fluid 306 into the sampling system 300, causing the pressure of the sampling system 300 to build. Once the pressure of the sampling system 300 reaches or exceeds a predefined threshold, a piston 318 can compress a spring 320 to displace a first volume 322*a* of hydraulic fluid 324 from a hydraulic fluid cavity 326. In response, the first volume 322*a* of the hydraulic fluid 324 can advance the sampling unit 310 by a predefined distance 328 from a first position to a second position, as described above with respect to FIG. 2.

By moving the sampling unit to the second position, a first sampling chamber 312*a* can be replaced by a second sampling chamber 312*b* to capture a sample of the formation fluid 306. In some examples, more than one sampling unit may be positioned in the sampling system 300 to receive the formation fluid 306 such that pressurizing the piston 318 can result in at least two concurrent samples being captured by the sampling units.

Depressurization in the sampling system 300 can occur when the valve 314 is opened, enabling the formation fluid 306 to freely exit the sampling system 300 through the sample fluid outlet 302. Once the pressure of the sampling system 300 decreases below the predefined threshold, the piston 318 can return to an equilibrium position due to a spring force provided by the spring 320. In response, as described with respect to FIG. 2, the hydraulic fluid cavity 326 can receive a second volume 322*b* of the hydraulic fluid 324 from a hydraulic fluid reservoir 330. The second volume 322*b* of the hydraulic fluid 324 can advance the sampling unit 310 by the predefined distance 328 once the pressure of the sampling system 300 exceeds the predefined threshold.

Although FIGS. 2-3 show a certain number and arrangement of components, these examples are intended to be illustrative and non-limiting. Other examples may include more components, fewer components, different components, or a different arrangement of the components shown in FIGS. 2-3. For instance, the sampling unit 216 or the sampling unit 310 may include fewer than or more than four sampling chambers. Any suitable arrangement of the depicted components is contemplated herein.

Figure 4:
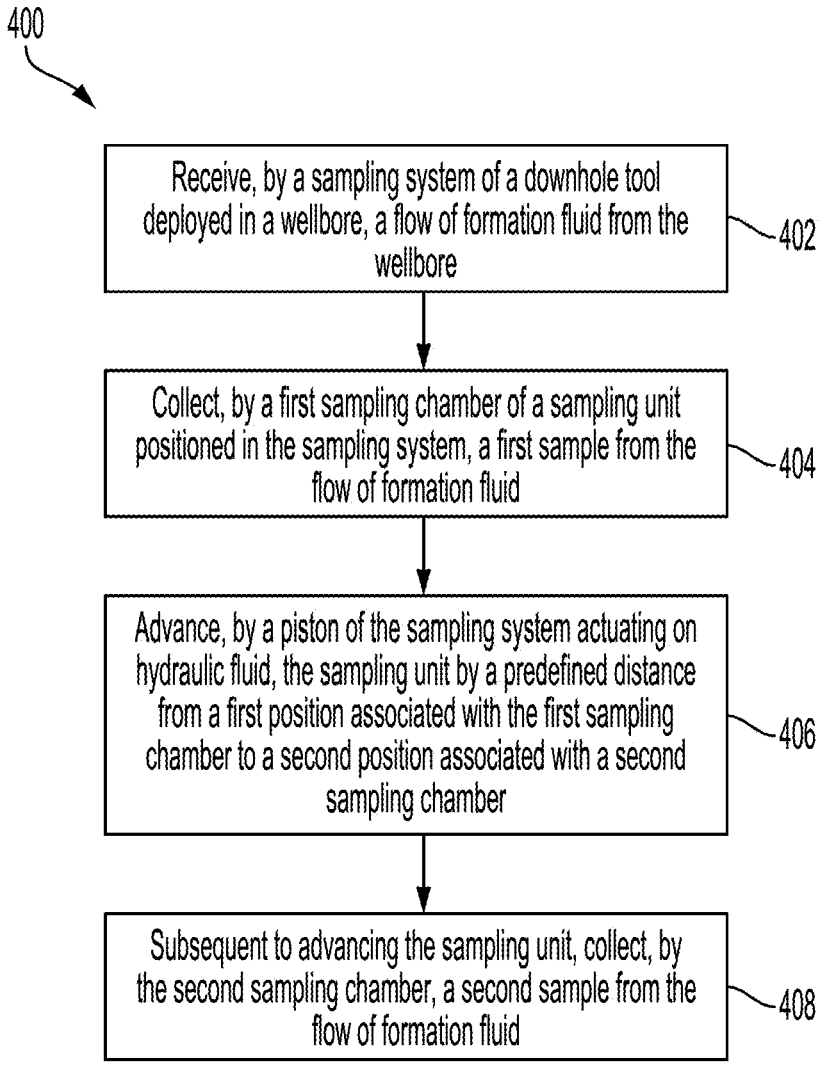
FIG. 4 is a flowchart of a process for using a downhole fluid sampling system with hydraulic actuation to collect samples of formation fluid according to one example of the present disclosure.

FIG. 4 is a flowchart of a process 400 for using a downhole fluid sampling system 200 with hydraulic actuation to collect samples of formation fluid 208 according to one example of the present disclosure. The sampling system 200 can be positioned in or be part of a downhole tool 114 deployed in a wellbore 104, for example as described with respect to FIG. 1. While FIG. 4 depicts a certain sequence of steps for illustrative purposes, other examples can involve more steps, fewer steps, different steps, or a different order of the steps depicted in FIG. 4. The steps of FIG. 4 are described below with reference to the components of FIGS. 1-2 described above.

In block 402, the sampling system 200 receives a flow of the formation fluid 208 from the wellbore 104. In some cases, the formation fluid 208 can be received by a sampling unit 216 of the sampling system 200 that can store or collect one or more samples 218 from the flow of the formation fluid 208. The sampling system 200 additionally can include a relief valve 220 positioned downstream from the sampling unit 216 that can prevent the formation fluid 208 from exiting the sampling system 200. For example, a relief valve 220 in a closed position can seal a formation fluid outlet 210 to prevent the formation fluid 208 from flowing out of the sampling system 200. As an amount of the formation fluid 208 within the sampling system 200 increases, pressure within the sampling system 200 may increase concurrently.

In block 404, a first sampling chamber 218*a* of the sampling unit 216 collects a first sample from the flow of the formation fluid 208. The sampling unit 216 can define a set of sampling chambers 218*a-d*, for example that can include the first sampling chamber 218*a* and a second sampling chamber 218*b*. In other examples, the set of sampling chambers 218*a-d* may include only one sampling chamber or more than two sampling chambers. For example, as depicted in FIG. 2, the sampling unit 216 includes four sampling chambers.

In block 406, a piston 226 of the sampling system 200 actuating on hydraulic fluid 228 advances the sampling unit 216 by a predefined distance 240 from a first position to a second position. The first position can be associated with the first sampling chamber 218*a*. Similarly, the second position can be associated with the second sampling chamber 218*b*. As the formation fluid 208 flows into the sampling system 200, the flow of the formation fluid 208 can pressurize the piston 226, causing the piston 226 to compress a spring 222*b* of the sampling system 200. In response, the piston 226 can displace a first volume 234*a* of the hydraulic fluid 228 that can advance the sampling unit 216 by the predefined distance 240 between the first position and the second position.

Additionally, increased pressure in the sampling system 200 can cause the relief valve 220 to unseal the formation fluid outlet 210 such that the flow of the formation fluid 208 can flow continuously from the formation fluid inlet 206 to the formation fluid outlet 210. As the formation fluid 208 flows through the sampling system 200, the formation fluid 208 can flush the second sampling chamber 218*b*, thereby removing contaminants from the second sampling chamber 218*b*.

Additionally, flushing the second sampling chamber 218*b* can prepare the second sampling chamber 218*b* for sample capture.

In block 408, subsequent to advancing the sampling unit 216, the second sampling chamber 218*b* collects a second sample from the flow of the formation fluid 208. In some examples, the second sample may be captured after a predetermined amount of time from collecting the first sample has passed. Accordingly, the samples collected by the sampling chambers 218*a-d* can be used to analyze properties of the formation fluid 208 over time.

In some examples, the sampling unit 216 may define more than two sampling chambers. Accordingly, the steps of block 406 and block 408 can be repeated until each remaining sampling chamber in the sampling unit 216 collects a respective sample of the formation fluid 208. As an example, if the sampling unit 216 defines three sampling chambers, the steps may be repeated such that a third sampling chamber 218*c* of the sampling unit 216 can collect a third sample of the formation fluid 208.

After each sampling chamber of the set of sampling chamber 218*a-d* is filled, the sampling unit 216 can be displaced such that the sampling unit 216 is positioned within a receiving unit 250 of the sampling system 200. The receiving unit 250 can store the sampling unit 216 until the sampling system 200 or the sampling unit 216 is returned to a well surface 108 of the wellbore 104 to analyze the samples stored in the sampling unit 216. In some cases, the sampling unit 216 can be removed from the sampling system 200 to retrieve each sample from the set of sampling chambers 218*a-d* for analysis.

In some aspects, a method, sampling system, and downhole tool for a downhole fluid sampling system with hydraulic actuation are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a sampling system comprising: a sampling unit positionable downhole in a wellbore to receive a flow of formation fluid from the wellbore, the sampling unit defining a set of sampling chambers that includes: a first sampling chamber positionable in the sampling unit to collect a first sample from the flow of formation fluid when the sampling unit is positioned at a first position in the sampling system; and a second sampling chamber positionable in the sampling unit to collect a second sample from the flow of formation fluid when the sampling unit is positioned at a second position in the sampling system; and a piston actuatable on hydraulic fluid of the sampling system to advance the sampling unit by a predefined distance from the first position associated with the first sampling chamber to the second position associated with the second sampling chamber.

Example 2 is the sampling system of example(s) 1, wherein the sampling system further comprises: a spring compressible by the piston, wherein the piston is actuatable on the spring and the hydraulic fluid by a pressurization of formation fluid; and a volume of the hydraulic fluid displaceable by the piston in response to compressing the spring, wherein the volume of the hydraulic fluid is positionable to advance the sampling unit by the predefined distance between the first position and the second position of the sampling unit in the sampling system.

Example 3 is the sampling system of example(s) 1-2, wherein the spring is positionable to return the piston to an equilibrium position upon depressurization by a lack of the flow of formation fluid; and wherein the sampling system further comprises: a fluid reservoir positionable to replace the volume of the hydraulic fluid, wherein the fluid reservoir includes a compensator positionable to equalize fluid pressure of the hydraulic fluid with ambient pressure, and wherein the compensator comprises a first seal friction that is less than a second seal friction of the sampling unit to maintain the sampling unit at the second position subsequent to depressurizing the piston.

Example 4 is the sampling system of example(s) 1-3, wherein the sampling system further comprises: a relief valve positionable to prevent the flow of formation fluid from exiting the sampling system via a formation fluid outlet sealable by the relief valve, wherein the relief valve is positionable to seal the formation fluid outlet when pressure provided by the flow of formation fluid is below a predefined threshold; a spring compressible by the relief valve when the pressure provided by the flow of formation fluid is greater than the predefined threshold, wherein the spring is positionable to provide a spring force corresponding to the predefined threshold, and wherein the relief valve is positionable to unseal the formation fluid outlet when the spring is compressed; and the second sampling chamber of the sampling unit that is, prior to collecting the second sample, flushable using the flow of formation fluid flowing through the sampling system to the formation fluid outlet.

Example 5 is the sampling system of example(s) 1-4, wherein the sampling unit further comprises a plurality of seals positioned between the first sampling chamber and the second sampling chamber to prevent intermixing between the first sample and the second sample.

Example 6 is the sampling system of example(s) 1-5, wherein the sampling system further comprises: a receiving unit positionable to store the sampling unit after each sampling chamber of the sampling unit collects a respective sample from the flow of formation fluid.

Example 7 is the sampling system of example(s) 1-6, wherein the sampling unit is removable from the sampling system to retrieve each sample from the set of sampling chambers for analysis.

Example 8 is a method comprising: receiving, by a sampling system of a downhole tool deployed in a wellbore, a flow of formation fluid from the wellbore; collecting, by a first sampling chamber of a sampling unit positioned in the sampling system, a first sample from the flow of formation fluid, the sampling unit defining a set of sampling chambers including the first sampling chamber and a second sampling chamber; advancing, by a piston of the sampling system actuating on hydraulic fluid, the sampling unit by a predefined distance from a first position associated with the first sampling chamber to a second position associated with the second sampling chamber; and subsequent to advancing the sampling unit, collecting, by the second sampling chamber, a second sample from the flow of formation fluid.

Example 9 is the method of example(s) 8, wherein advancing the sampling unit further comprises: pressurizing, by the flow of formation fluid, the piston to compress a spring of the sampling system; and in response to compressing the spring, displacing, by the piston, a volume of the hydraulic fluid, wherein the volume of the hydraulic fluid advances the sampling unit by the predefined distance between the first position and the second position.

Example 10 is the method of example(s) 8-9, further comprising: depressurizing, by a lack of the flow of formation fluid, the piston to return the piston to an equilibrium position by a spring force provided by the spring; in response to the piston returning to the equilibrium position, replacing the volume of the hydraulic fluid from a fluid reservoir that includes a compensator used to equalize fluid pressure of the hydraulic fluid with ambient pressure; and subsequent to depressurizing the piston, maintaining the sampling unit at the second position, wherein a first seal friction of the compensator is less than a second seal friction of the sampling unit.

Example 11 is the method of example(s) 8-10, further comprising, prior to collecting the second sample: preventing, by a relief valve, the flow of formation fluid from exiting the sampling system via a formation fluid outlet sealed by the relief valve, wherein the relief valve seals the formation fluid outlet when pressure provided by the flow of formation fluid is below a predefined threshold; in response to the pressure provided by the flow of formation fluid being above the predefined threshold, compressing, by the relief valve, a spring to cause the relief valve to unseal the formation fluid outlet; and subsequent to unsealing the formation fluid outlet, flushing the second sampling chamber of the sampling unit using the flow of formation fluid flowing through the sampling system to the formation fluid outlet, wherein the flow of formation fluid removes contaminants from the second sampling chamber.

Example 12 is the method of example(s) 8-11, wherein the sampling unit further comprises a plurality of seals positioned between the first sampling chamber and the second sampling chamber to prevent intermixing between the first sample and the second sample.

Example 13 is the method of example(s) 8-12, further comprising: collecting a respective sample using each remaining sampling chamber of the set of sampling chambers; and in response, displacing the sampling unit toward a receiving unit of the sampling system, wherein the receiving unit stores the sampling unit after each sampling chamber of the sampling unit is filled.

Example 14 is the method of example(s) 8-13, wherein the sampling unit is removable from the sampling system to retrieve each sample from the set of sampling chambers for analysis.

Example 15 is a downhole tool comprising: a tool string positionable downhole in a wellbore; and a sampling system couplable to the tool string, the sampling system comprising: a sampling unit positionable to receive a flow of formation fluid from the wellbore, the sampling unit defining a set of sampling chambers that includes: a first sampling chamber positionable in the sampling unit to collect a first sample from the flow of formation fluid when the sampling unit is positioned at a first position in the sampling system; and a second sampling chamber positionable in the sampling unit to collect a second sample from the flow of formation fluid when the sampling unit is positioned at a second position in the sampling system; and a piston actuatable on hydraulic fluid of the sampling system to advance the sampling unit by a predefined distance from the first position associated with the first sampling chamber to the second position associated with the second sampling chamber.

Example 16 is the downhole tool of example(s) 15, wherein the downhole tool further comprises: a spring of the sampling system that is compressible by the piston that is pressurized by the flow of formation fluid; and a volume of the hydraulic fluid displaceable by the piston in response to compressing the spring, wherein the volume of the hydraulic fluid is positionable to advance the sampling unit by the predefined distance between the first position and the second position.

Example 17 is the downhole tool of example(s) 15-16, wherein the spring is positionable to return the piston to an equilibrium position upon depressurization by a lack of the flow of formation fluid; and a fluid reservoir positionable to replace the volume of the hydraulic fluid, wherein the fluid reservoir includes a compensator positionable to equalize fluid pressure of the hydraulic fluid with ambient pressure, wherein the compensator has a first seal friction that is less than a second seal friction of the sampling unit to maintain the sampling unit at the second position subsequent to depressurizing the piston.

Example 18 is the downhole tool of example(s) 15-17, wherein the downhole tool further comprises: a relief valve positionable to prevent the flow of formation fluid from exiting the sampling system via a formation fluid outlet sealable by the relief valve, wherein the relief valve is positionable to seal the formation fluid outlet when pressure provided by the flow of formation fluid is below a predefined threshold; a spring compressible by the relief valve when the pressure provided by the flow of formation fluid is above the predefined threshold, wherein the spring is positionable to provide a spring force corresponding to the predefined threshold, wherein the relief valve is positionable to unseal the formation fluid outlet when the spring is compressed; and the second sampling chamber of the sampling unit that is, prior to collecting the second sample, flushable using the flow of formation fluid flowing through the sampling system to the formation fluid outlet, wherein the flow of formation fluid removes contaminants from the second sampling chamber.

Example 19 is the downhole tool of example(s) 15-18, wherein the sampling unit further comprises a plurality of seals positioned between the first sampling chamber and the second sampling chamber to prevent intermixing between the first sample and the second sample.

Example 20 is the downhole tool of example(s) 15-19, wherein the downhole tool further comprises: a receiving unit positionable to store the sampling unit after each sampling chamber of the sampling unit collects a respective sample from the flow of formation fluid.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A sampling system comprising:

a sampling unit positionable downhole in a wellbore to receive a flow of formation fluid from the wellbore, the sampling unit defining a set of sampling chambers that includes:

a first sampling chamber positionable in the sampling unit to collect a first sample from the flow of formation fluid when the sampling unit is positioned at a first position in the sampling system; and a second sampling chamber positionable in the sampling unit to collect a second sample from the flow of formation fluid when the sampling unit is positioned at a second position in the sampling system; and a piston actuatable on hydraulic fluid of the sampling system to displace at least a portion of the hydraulic fluid to cause the sampling unit to advance by a predefined distance from the first position associated with the first sampling chamber to the second position associated with the second sampling chamber.

2. The sampling system of claim 1, wherein the sampling system further comprises:

a spring compressible by the piston, wherein the piston is actuatable on the spring and the hydraulic fluid by a pressurization of formation fluid; and a volume of the hydraulic fluid displaceable by the piston in response to compressing the spring, wherein the volume of the hydraulic fluid is positionable to advance the sampling unit by the predefined distance between the first position and the second position of the sampling unit in the sampling system.

3. The sampling system of claim 2, wherein the spring is positionable to return the piston to an equilibrium position upon depressurization by a lack of the flow of formation fluid; and wherein the sampling system further comprises:

a fluid reservoir positionable to replace the volume of the hydraulic fluid, wherein the fluid reservoir includes a compensator positionable to equalize fluid pressure of the hydraulic fluid with ambient pressure, and wherein the compensator comprises a first seal friction that is less than a second seal friction of the sampling unit to maintain the sampling unit at the second position subsequent to depressurizing the piston.

4. The sampling system of claim 1, wherein the sampling system further comprises:

a relief valve positionable to prevent the flow of formation fluid from exiting the sampling system via a formation fluid outlet sealable by the relief valve, wherein the relief valve is positionable to seal the formation fluid outlet when pressure provided by the flow of formation fluid is below a predefined threshold;

a spring compressible by the relief valve when the pressure provided by the flow of formation fluid is greater than the predefined threshold, wherein the spring is positionable to provide a spring force corresponding to the predefined threshold, and wherein the relief valve is positionable to unseal the formation fluid outlet when the spring is com pressed; and the second sampling chamber of the sampling unit that is, prior to collecting the second sample, flushable using the flow of formation fluid flowing through the sampling system to the formation fluid outlet.

5. The sampling system of claim 1, wherein the sampling unit further comprises a plurality of seals positioned between the first sampling chamber and the second sampling chamber to prevent intermixing between the first sample and the second sample.

6. The sampling system of claim 1, wherein the sampling system further comprises:

a receiving unit positionable to store the sampling unit after each sampling chamber of the sampling unit collects a respective sample from the flow of formation fluid.

7. The sampling system of claim 1, wherein the sampling unit is removable from the sampling system to retrieve each sample from the set of sampling chambers for analysis.

8. A method comprising:

receiving, by a sampling system of a downhole tool deployed in a wellbore, a flow of formation fluid from the wellbore;

collecting, by a first sampling chamber of a sampling unit positioned in the sampling system, a first sample from the flow of formation fluid, the sampling unit defining a set of sampling chambers including the first sampling chamber and a second sampling chamber;

advancing, by a piston of the sampling system actuating on hydraulic fluid to displace at least a portion of the hydraulic fluid, the sampling unit by a predefined distance from a first position associated with the first sampling chamber to a second position associated with the second sampling chamber; and subsequent to advancing the sampling unit, collecting, by the second sampling chamber, a second sample from the flow of formation fluid.

9. The method of claim 8, wherein advancing the sampling unit further comprises:

pressurizing, by the flow of formation fluid, the piston to compress a spring of the sampling system; and in response to compressing the spring, displacing, by the piston, a volume of the hydraulic fluid, wherein the volume of the hydraulic fluid advances the sampling unit by the predefined distance between the first position and the second position.

10. The method of claim 9, further comprising:

depressurizing, by a lack of the flow of formation fluid, the piston to return the piston to an equilibrium position by a spring force provided by the spring;

in response to the piston returning to the equilibrium position, replacing the volume of the hydraulic fluid from a fluid reservoir that includes a compensator used to equalize fluid pressure of the hydraulic fluid with ambient pressure; and subsequent to depressurizing the piston, maintaining the sampling unit at the second position, wherein a first seal friction of the compensator is less than a second seal friction of the sampling unit.

11. The method of claim 8, further comprising, prior to collecting the second sample:

preventing, by a relief valve, the flow of formation fluid from exiting the sampling system via a formation fluid outlet sealed by the relief valve, wherein the relief valve seals the formation fluid outlet when pressure provided by the flow of formation fluid is below a predefined threshold;

in response to the pressure provided by the flow of formation fluid being above the predefined threshold, compressing, by the relief valve, a spring to cause the relief valve to unseal the formation fluid outlet; and subsequent to unsealing the formation fluid outlet, flushing the second sampling chamber of the sampling unit using the flow of formation fluid flowing through the sampling system to the formation fluid outlet, wherein the flow of formation fluid removes contaminants from the second sampling chamber.

12. The method of claim 8, wherein the sampling unit further comprises a plurality of seals positioned between the first sampling chamber and the second sampling chamber to prevent intermixing between the first sample and the second sample.

13. The method of claim 8, further comprising:

collecting a respective sample using each remaining sampling chamber of the set of sampling chambers; and in response, displacing the sampling unit toward a receiving unit of the sampling system, wherein the receiving unit stores the sampling unit after each sampling chamber of the sampling unit is filled.

14. The method of claim 8, wherein the sampling unit is removable from the sampling system to retrieve each sample from the set of sampling chambers for analysis.

15. A downhole tool comprising:

a tool string positionable downhole in a wellbore; and a sampling system couplable to the tool string, the sampling system comprising:

a sampling unit positionable to receive a flow of formation fluid from the wellbore, the sampling unit defining a set of sampling chambers that includes:

a first sampling chamber positionable in the sampling unit to collect a first sample from the flow of formation fluid when the sampling unit is positioned at a first position in the sampling system; and a second sampling chamber positionable in the sampling unit to collect a second sample from the flow of formation fluid when the sampling unit is positioned at a second position in the sampling system; and a piston actuatable on hydraulic fluid of the sampling system to displace at least a portion of the hydraulic fluid to cause the sampling unit to advance by a predefined distance from the first position associated with the first sampling chamber to the second position associated with the second sampling chamber.

16. The downhole tool of claim 15, wherein the downhole tool further comprises:

a spring of the sampling system that is compressible by the piston that is pressurized by the flow of formation fluid; and a volume of the hydraulic fluid displaceable by the piston in response to compressing the spring, wherein the volume of the hydraulic fluid is positionable to advance the sampling unit by the predefined distance between the first position and the second position.

17. The downhole tool of claim 16, wherein the spring is positionable to return the piston to an equilibrium position upon depressurization by a lack of the flow of formation fluid; and a fluid reservoir positionable to replace the volume of the hydraulic fluid, wherein the fluid reservoir includes a compensator positionable to equalize fluid pressure of the hydraulic fluid with ambient pressure, wherein the compensator has a first seal friction that is less than a second seal friction of the sampling unit to maintain the sampling unit at the second position subsequent to depressurizing the piston.

18. The downhole tool of claim 15, wherein the downhole tool further comprises:

a relief valve positionable to prevent the flow of formation fluid from exiting the sampling system via a formation fluid outlet sealable by the relief valve, wherein the relief valve is positionable to seal the formation fluid outlet when pressure provided by the flow of formation fluid is below a predefined threshold;

a spring compressible by the relief valve when the pressure provided by the flow of formation fluid is above the predefined threshold, wherein the spring is positionable to provide a spring force corresponding to the predefined threshold, wherein the relief valve is positionable to unseal the formation fluid outlet when the spring is compressed; and the second sampling chamber of the sampling unit that is, prior to collecting the second sample, flushable using the flow of formation fluid flowing through the sampling system to the formation fluid outlet, wherein the flow of formation fluid removes contaminants from the second sampling chamber.

19. The downhole tool of claim 15, wherein the sampling unit further comprises a plurality of seals positioned between the first sampling chamber and the second sampling chamber to prevent intermixing between the first sample and the second sample.

20. The downhole tool of claim 15, wherein the downhole tool further comprises:

a receiving unit positionable to store the sampling unit after each sampling chamber of the sampling unit collects a respective sample from the flow of formation fluid.

* * * * *